US005275482A

United States Patent [19]

Grant

[11] Patent Number: 5,275,482

[45] Date of Patent: Jan. 4, 1994

[54] COMPUTER TERMINAL APPARATUS

[76] Inventor: Angela M. Grant, 1185 S. Ridgeway Rd., Hazelton, Id. 83335

[21] Appl. No.: 622,625

[22] Filed: Dec. 5, 1990

[51] Int. Cl.[5] ..... A47B 83/00

[52] U.S. Cl. ..... 312/235.9; 312/223.3; 297/174; 297/188

[58] Field of Search ..... 312/235.2, 7.2, 235.9, 312/223.3; 297/172, 147, 174, 135, 217, 188; 364/708; 361/390

[56] References Cited

U.S. PATENT DOCUMENTS

| | | | |
|---|---|---|---|
| 1,430,465 | 9/1922 | Niemuth | 297/174 |
| 4,173,024 | 10/1979 | Miller | 312/239 |
| 4,779,922 | 10/1988 | Cooper | 297/188 |
| 4,861,121 | 8/1989 | Gotz | 312/7.2 |

FOREIGN PATENT DOCUMENTS

| | | | |
|---|---|---|---|
| 0379713 | 8/1964 | Switzerland | 297/172 |

*Primary Examiner*—Kenneth J. Dorner
*Assistant Examiner*—Gerald A. Anderson
*Attorney, Agent, or Firm*—Leon Gilden

[57] ABSTRACT

An apparatus wherein a "U" shaped support base including spaced parallel legs mounts a chair member therebetween, wherein the chair member is oriented at an acute angle between the base legs and includes an adjustable lumbar assembly to effect adjustable lumbar support during use of the chair. The terminal apparatus includes a key board support shelf and a monitor support shelf which may be adjustably mounted relative to the base.

3 Claims, 4 Drawing Sheets

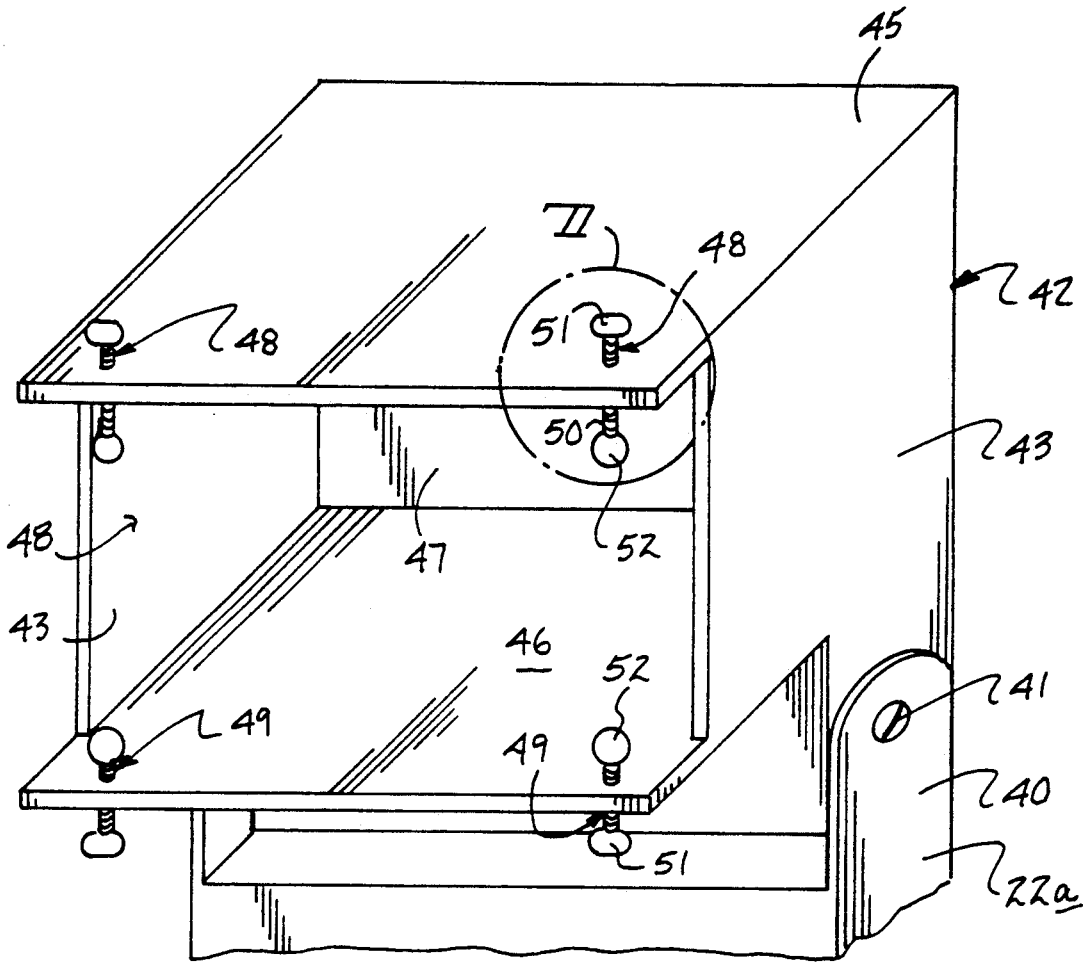
Fig 6
Fig 7
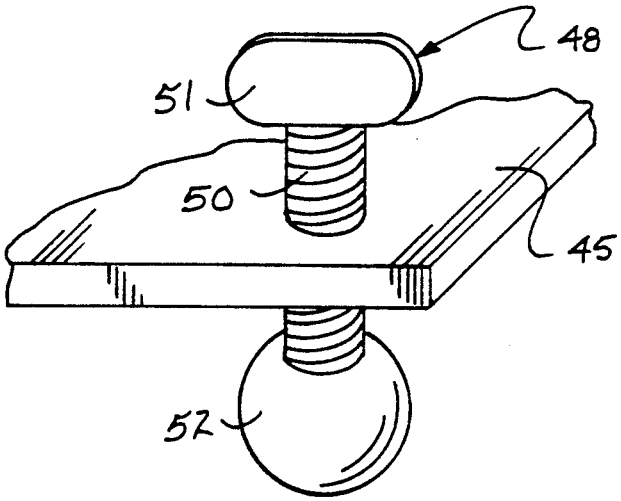

COMPUTER TERMINAL APPARATUS

BACKGROUND OF THE INVENTION

1. Field of the Invention

The field of invention relates to furniture structure, and more particularly pertains to a new and improved computer terminal apparatus wherein the same sets forth comfort and ease of use of the organization by individuals at a computer terminal.

2. Description of the Prior Art

Various chair structure has been set forth in the prior art for use in combination with work station environments. The instant invention attempts to overcome deficiencies of the prior art by setting forth a terminal structure wherein the same conveniently and comfortably mounts an individual relative to the terminal structure of a typical computer work station. Examples of the prior art include U.S. Pat. No. 4,695,903 to Scrap, et al. wherein an audio/video module includes a chair fixedly mounted relative to a screen and work station.

U.S. Pat. No. 4,826,245 to Entratder sets forth a chair structure for use in private viewing, wherein the chair is mounted upon a swivel base and includes an array of speakers and control units mounted within the chair assembly.

U.S. Pat. No. 4,685,728 to Rebollo sets forth a self-contained outdoor sports seating chair wherein the same is arranged for insulatively mounting the chair to an underlying support structure such as a bench seat.

U.S. Pat. No. 3,762,767 to Powell sets forth an environmental type chair wherein a reclining seat utilizes a shell structure mounting various lights and like to effect environmental comfort of an individual mounted within the chair structure and similarly, U.S. Pat. No. 4,470,631 to the same inventor sets forth a chair structure mounted within a shell organization, wherein the chair is mounted within a pivot axle orienting the chair within the chair.

As such, it may be appreciated that there continues to be a need for a new and improved computer terminal apparatus as set forth by the instant invention which addresses both the problems of ease of use as well as effectiveness utilizing a chair organization mounted within a terminal structure for comfort and convenience of an individual oriented relative to a computer work station.

SUMMARY OF THE INVENTION

In view of the foregoing disadvantages inherent in the known types of chair structures now present in the prior art, the present invention provides a computer terminal apparatus wherein the same sets forth a chair structure conveniently mounted within a computer terminal work station. As such, the general purpose of the present invention, which will be described subsequently in greater detail, is to provide a new and improved computer terminal apparatus which has all the advantages of the prior art chair organizations and none of the disadvantages.

To attain this, the present invention provides an apparatus wherein a "U" shaped support base includes spaced parallel legs mounting a chair member therebetween, wherein the chair member is oriented at an acute angle between the base legs and includes an adjustable lumbar assembly to effect adjustable lumbar support during use of the chair. The terminal apparatus includes a key board support shelf and a monitor support shelf which may be adjustably mounted relative to the base.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved computer terminal apparatus which has all the advantages of the prior art chair organizations and none of the disadvantages.

It is another object of the present invention to provide a new and improved computer terminal apparatus which may be easily and efficiently manufactured and marketed.

It is a further object of the present invention to provide a new and improved computer terminal apparatus which is of a durable and reliable construction.

An even further object of the present invention is to provide a new and improved computer terminal apparatus which is susceptible of a low cost of manufacture with regard to both materials and labor, and which accordingly is then susceptible of low prices of sale to the consuming public, thereby making such computer terminal apparatus economically available to the buying public.

Still yet another object of the present invention is to provide a new and improved computer terminal apparatus which provides in the apparatuses and methods of the prior art some of the advantages thereof, while simultaneously overcoming some of the disadvantages normally associated therewith.

Still another object of the present invention is to provide a new and improved computer terminal apparatus wherein the same mounts a chair for convenience relative to a computer terminal work station.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an isometric illustration of a modified monitor housing utilized by the instant invention.

FIG. 7 is an isometric illustration of Section 7 as set forth in FIG. 6.

DESCRIPTION OF THE PREFERRED EMBODIMENT

Figure 1:
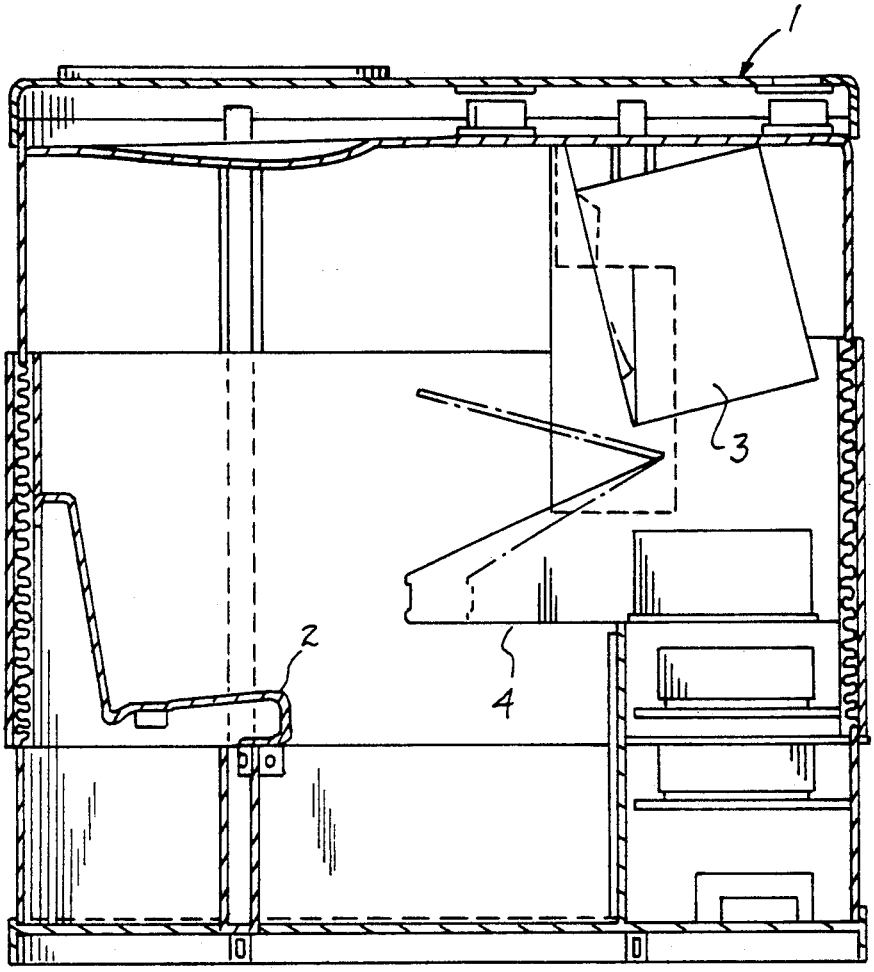
FIG 1 PRIOR ART
FIG. 1 is an orthographic cross-sectional illustration of a prior art chair and work station.

With reference now to the drawings, and in particular to FIGS. 1 to 7 thereof, a new and improved computer terminal apparatus embodying the principles and concepts of the present invention and generally designated by the reference numeral 10 will be described.

FIG. 1 illustrates a prior art work station organization 1, wherein a fixedly mounted chair 2 is mounted within the module, including control panel support 4 and a monitor 3 arranged in a fixed relationship relative to the chair structure, as set forth in U.S. Pat. No. 4,695,903.

Figure 2:
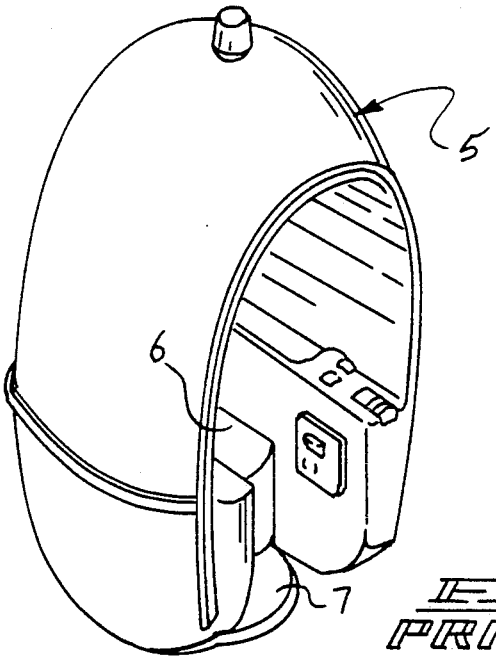
FIG 2 PRIOR ART
FIG. 2 is an isometric illustration of a prior art chair module.
Figure 3:
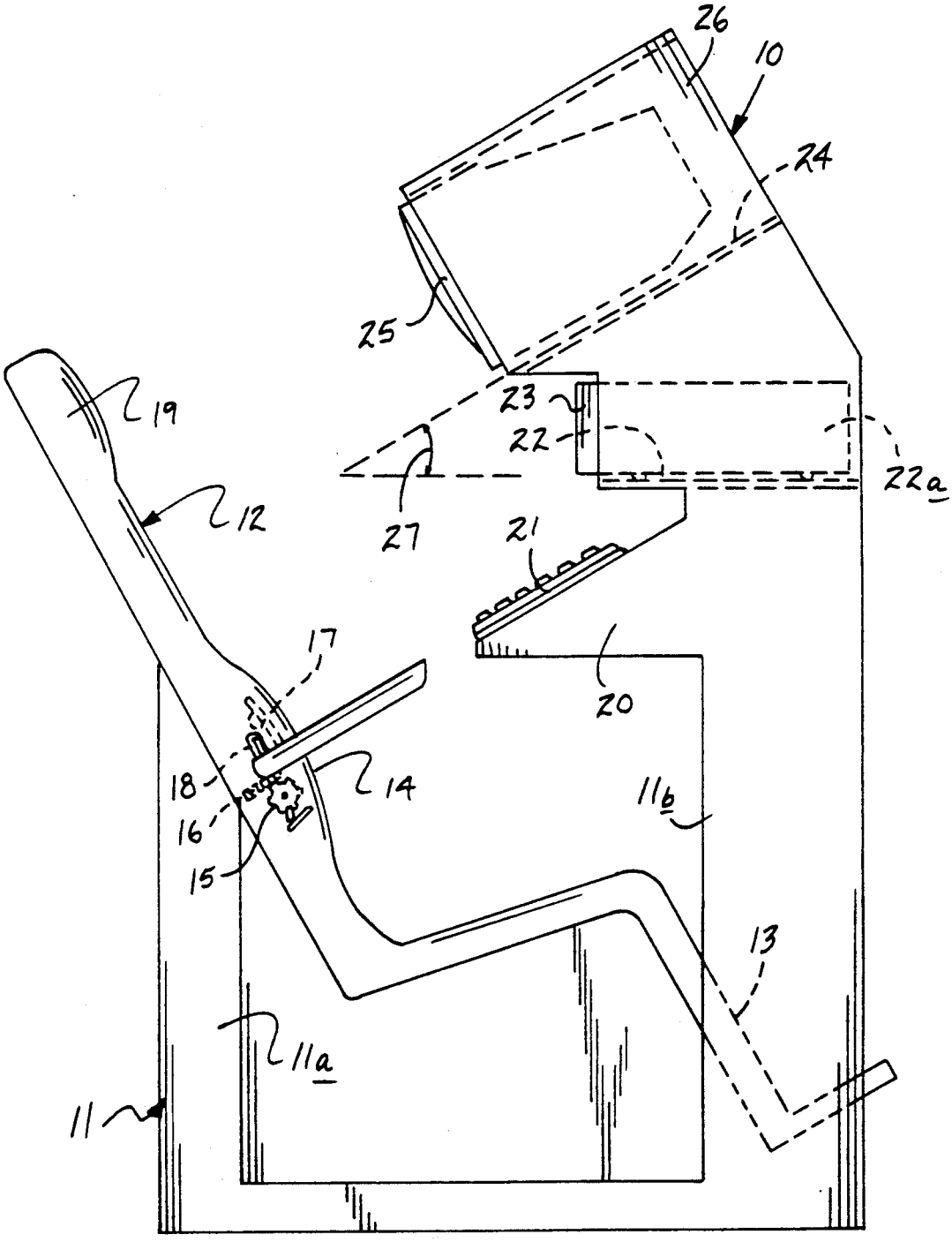
FIG. 3 is an orthographic side view, taken in elevation, of the instant invention.

FIG. 2 illustrates a further prior art seating arrangement, wherein the organization 5 is of a generally ovate configuration mounted upon a swivel base 7, wherein the organization includes a seat 6 fixedly mounted within the ovate housing utilizing various control panels and speakers mounted within the housing, as set forth in U.S. Pat. No. 4,826,245.

More specifically, the computer terminal apparatus 10 of the instant invention essentially comprises a "U" shaped base 11, including a rear base leg 11*a* in a parallel relationship to a forward base leg 11*b*. A seat member 12 is mounted on the "U" shaped base and mounted at an acute angle upon the rear base leg of 11*a* and extending forwardly to the forward base leg 11*b* at an intersection therewith below the mounting of the seat member 12 with the rear base leg 11*a*. The seat leg portion 13 of the seat 12 is mounted to the forward base leg 11*b* as illustrated below the "L" shaped torso support portion of the seat 12 that is mounted fixedly upon the upper terminal end of the rear base leg 11*a*. A padded lumbar projection 14 mounted medially of the "L" shaped seat torso support portion includes a control rack 15 operative with a control pinion 16 to adjust projection of an arcuate lumbar support plate 17 within the lumbar projection 14. A vertical slot 18 mounting the control rack and pinion 15 and 16 permits vertical adjustment of the lumbar support adjustment organization. A plurality of arm rests are also mounted for use with the organization. A neck support 19 is provided which may be pivotally mounted (not shown) for contour adjustment of a neck portion of an individual.

The assembly includes a key board support shelf 20 that projects interiorly of the "U" shaped base 11 and mounts a computer key board 21 thereon. A computer terminal shelf 22 is mounted above and rearwardly of the key board support shelf 20 and mounts the computer terminal 23 thereon between spaced parallel computer terminal shelf sidewalls 22*a*. A monitor shelf 24 mounts a monitor 25 thereon, with the monitor shelf 24 defining an acute angle 27 defined between the monitor shelf 24 and the computer terminal shelf 22 to angulate the monitor towards the torso portion of the seat 12 to arrange the forward face of the monitor generally parallel relative to the torso portion of the seat. Monitor shelf side walls 26 enclose the monitor for securement thereof. The backwall, relative to the monitor shelf, is open for proper ventilation of equipment mounted thereon.

Figure 4:
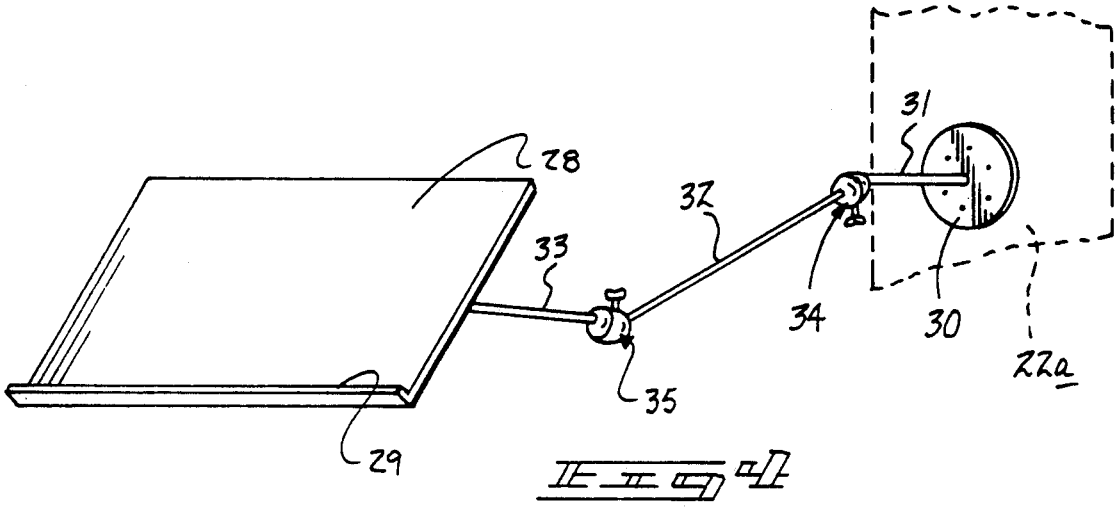
FIG. 4 is an isometric illustration of a modified key board support shelf utilized by the instant invention.
Figure 5:
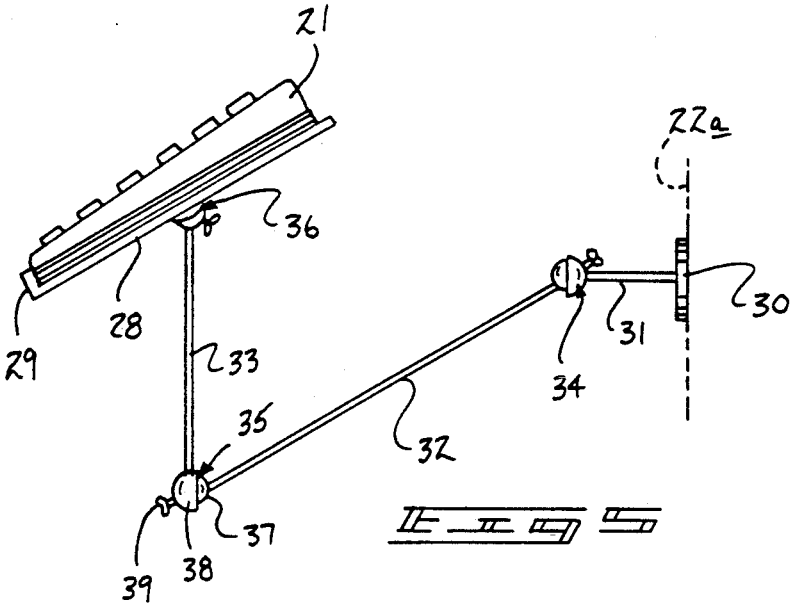
FIG. 5 is an orthographic side view, taken in elevation, of the modified computer key board support shelf utilized by the instant invention.

FIGS. 4 and 5 illustrate the use of a modified key board support plate 28 that includes a plate flange 29 integrally and orthogonally mounted to a lower terminal end thereof and projecting upwardly thereof to mount the key board 21 thereon. The mounting base member 30 fixedly mounts the organization to a computer terminal shelf side wall 22*a* and includes a first, second, and third rigid link 31, 32, and 33. The first rigid link 31 is orthogonally and fixedly mounted to the mounting base member 30. The first rigid link is pivotally and adjustably mounted to the second pivot link 32 by a first socket joint 34. A second socket joint 35 adjustably amounts the second rigid link 32 to the third rigid link 33. The third rigid link 33 is adjustably mounted to a bottom surface of the key board support plate 28 by a third socket joint 36. Each socket joint includes a ball 37 rotatably mounted within a semispherical socket 38. A threaded rod member 39 radially projects interiorly of the socket to fixedly secure the ball 37 in a predetermined angular orientation relative to the socket 38.

FIGS. 6 and 7 illustrate the use of a modified monitor support organization wherein bifurcated side walls 40 define upper terminal ends of the terminal shelf side walls 22*a*. Clamp connectors 41 rotatably adjust a monitor hood support 42 relative to the bifurcated side walls 40. Parallel hood side walls 43 are orthogonally mounted to opposed sides of a floor 46. A rear end wall 47 defines an enclosure with a forward opened end wall opening 48 to position the associated monitor 25 within the enclosure or hood support 42. The top wall 45 and the bottom wall 46 each include overlying and aligned terminal ends, with a top wall clamp pair 48 and a floor clamp pair 49 orthogonally projecting through the top wall and floor adjacent the forward terminal ends thereof. Each clamp of the top clamp pair 48 is coaxially aligned with underlying respective clamp of the floor clamp pair 49. Each clamp includes a threaded detent rod 50 orthogonally directed through the top wall or floor, with the handle member 51 integrally and orthogonally mounting an upper terminal end of each detent rod 50. A polymeric resilient clamping sphere 52 is fixedly mounted to a lower terminal end of each rod 50 to fixedly secure a monitor between the plurality of clamp pairs to permit rotation of the hood support 42 in a desired angular orientation relative to the computer terminal shelf 22 that remains at an acute included angle 27.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A computer terminal apparatus comprising, in combination,

"U" shaped base, the "U" shaped base including a rear base leg and a forward base leg, with the rear and forward base legs arranged in a parallel spaced relationship, and a seat member mounted upon the "U" shaped base, and the forward base leg extending upwardly and including a keyboard support shelf for mounting a computer keyboard thereon, and the forward base leg extending above the keyboard support shelf and including a computer terminal shelf for mounting a computer terminal thereon, and the forward base leg further including a computer monitor shelf spaced above said computer terminal shelf for mounting a computer monitor thereon, the rear base rear base leg includes a rear base leg upper terminal end, and the seat member includes an "L" shaped torso support portion fixedly mounted on the rear base leg upper terminal end, the "L" shaped torso support portion including a lumbar support portion defining an acute included angle relative to said rear base leg interiorly of the "U" shaped base between the rear base leg upper terminal end and the "L" shaped seat torso support portion, and the seat member extending across the "U" shaped base and mounted to the forward base leg below the rear base leg upper terminal end, and the keyboard support shelf includes a plate member and a plate flange fixedly and orthogonally mounted to a lower terminal end of the keyboard support shelf, and a mounting base member fixedly mounted to a computer terminal shelf side wall, and the base member including a first rigid link fixedly mounted to the mounting base member, and a second rigid link pivotally mounted to the first rigid link including a first socket joint mounted between the first rigid link and the second rigid link, and a third rigid link with a second socket joint pivotally mounting the third rigid link to the second rigid link, and the third rigid link mounted to a bottom surface of the keyboard support plate including a third socket joint pivotally mounting the third rigid link to the keyboard support plate spaced from the second socket joint, and each socket joint includes a ball member and the ball member rotatably mounted within a semi-spherical socket, and the socket including a threaded rod member radially directed into each socket to fixedly and adjustably mount each ball rotatably within each socket at an adjustable relationship.

2. An apparatus as set forth in claim 1 wherein the monitor shelf defines a floor, and the floor rotatably mounted between the computer terminal shelf side walls, and the floor includes spaced monitor side walls, and the monitor top wall parallel to and overlying the floor, and the floor including a floor forward terminal end and the top wall including a top wall forward terminal end, and a computer monitor receivable between the floor and the top wall, and a top wall clamp pair orthogonally directed through the top wall adjacent the top wall forward terminal end, and each clamp of the top wall clamp pair including a threaded rod member orthogonally directed through the top wall and including a handle member mounted to a top terminal end of the rod, and a spherical resilient clamping sphere mounted to a lower terminal end of each rod, and the floor including a floor clamp pair, and each floor clamp of the floor clamp pair coaxially aligned with an overlying top wall clamp of the top wall clamp pair, and each floor clamp of the floor clamp pair including a further rod threadedly directed through the floor and the further rod including a handle mounted to a lower terminal end of the further rod, and the further rod including a spherical resilient further clamping sphere mounted to each upper terminal end of each further rod.

3. An apparatus as set forth in claim 2 wherein the "L" shaped seat torso support portion of the seat member includes a lumbar adjustment means positioned within the "L" shaped seat torso support portion for adjustment of the lumbar support of the "L" shaped seat torso support portion.

* * * * *